US009334609B2

(12) United States Patent
Makimura et al.

(10) Patent No.: US 9,334,609 B2
(45) Date of Patent: May 10, 2016

(54) LEATHER-LIKE SHEET AND PROCESS FOR PRODUCING THE SAME

(75) Inventors: Masaru Makimura, Okayama (JP); Hidekazu Andoh, Okayama (JP); Michinori Fujisawa, Okayama (JP); Yasunori Murate, Okayama (JP); Yoshiyuki Ando, Okayama (JP); Yoshiki Nobuto, Okayama (JP); Norio Makiyama, Okayama (JP)

(73) Assignee: KURARAY CO., LTD., Kurashiki-shi (JP)

( * ) Notice: Subject to any disclaimer, the term of this patent is extended or adjusted under 35 U.S.C. 154(b) by 1267 days.

(21) Appl. No.: 12/675,573

(22) PCT Filed: Aug. 28, 2008

(86) PCT No.: PCT/JP2008/065411

§ 371 (c)(1),
(2), (4) Date: Feb. 26, 2010

(87) PCT Pub. No.: WO2009/028610

PCT Pub. Date: Mar. 5, 2009

(65) Prior Publication Data

US 2010/0239817 A1 Sep. 23, 2010

(30) Foreign Application Priority Data

Aug. 28, 2007 (JP) ..... 2007-221471

(51) Int. Cl.

| | |
|---|---|
| ***D06N 3/00*** | (2006.01) |
| ***D04H 1/4382*** | (2012.01) |
| ***D04H 13/00*** | (2006.01) |

(52) U.S. Cl.

CPC ..... *D06N 3/0004* (2013.01); *D04H 1/4382* (2013.01); *D04H 13/002* (2013.01); *D06N 3/0013* (2013.01); *Y10T 428/24438* (2015.01); *Y10T 442/2377* (2015.04)

(58) Field of Classification Search

USPC ..... 428/151; 442/105, 361–365

See application file for complete search history.

(56) References Cited

U.S. PATENT DOCUMENTS

| | | | | |
|---|---|---|---|---|
| 3,455,773 | A * | 7/1969 | Tessier | 428/114 |
| 5,454,145 | A * | 10/1995 | Wattel et al. | 19/163 |
| 6,652,599 | B1 * | 11/2003 | Inuzuka et al. | 8/115.51 |

(Continued)

FOREIGN PATENT DOCUMENTS

| | | |
|---|---|---|
| JP | 60 252757 | 12/1985 |
| JP | 11 140779 | 5/1999 |

(Continued)

*Primary Examiner* — Maria Veronica Ewald
*Assistant Examiner* — Brian Handville
(74) *Attorney, Agent, or Firm* — Oblon, McClelland, Maier & Neustadt, L.L.P.

(57) ABSTRACT

A leather-like sheet containing a microfine long-fiber nonwoven fabric containing an entangled web structure made of bundles of microfine long fibers and an elastic polymer impregnated in the microfine long-fiber nonwoven fabric. The leather-like sheet has a machine direction/transverse direction ratio of breaking strength of 1/1 to 1.3/1, an elongation at break in each of the machine direction and the transverse direction of 80% or more, and a machine direction/transverse direction ratio of elongation at break of 1/1 to 1/1.5. The leather-like sheet has a natural dense feeling, a soft hand, a small difference of mechanical properties in the machine direction and the transverse direction, a moderate resistance to elongation and a durable recovery.

9 Claims, 1 Drawing Sheet

(56) References Cited

U.S. PATENT DOCUMENTS

| | | | | |
|---|---|---|---|---|
| 7,932,192 | B2 * | 4/2011 | Fujisawa et al. | 442/164 |
| 2002/0098756 | A1 | 7/2002 | Sasaki et al. | |
| 2003/0022575 | A1 | 1/2003 | Yoneda et al. | |
| 2004/0157037 | A1 * | 8/2004 | Yamaguchi et al. | 442/104 |
| 2004/0242100 | A1 * | 12/2004 | Nobuto et al. | 442/104 |
| 2009/0053948 | A1 * | 2/2009 | Fujisawa et al. | 442/164 |

FOREIGN PATENT DOCUMENTS

| | | |
|---|---|---|
| JP | 2000 273769 | 10/2000 |
| JP | 2003 013369 | 1/2003 |
| JP | 2003 336157 | 11/2003 |
| JP | 2004 11075 | 1/2004 |
| WO | 2007 069628 | 6/2007 |

* cited by examiner

LEATHER-LIKE SHEET AND PROCESS FOR PRODUCING THE SAME

TECHNICAL FIELD

The present invention relates to a leather-like sheet, and more specifically to a leather-like sheet having a natural dense feeling similar to that of natural leathers and a soft hand, which is further characterized by having a small difference in mechanical properties between the machine direction and the transverse direction (MD and TD), a moderate resistance to elongation and a long-lasting recovery.

BACKGROUND ART

There has been made several proposals about a leather-like sheet having a natural dense feeling similar to that of natural leathers and a soft hand, which has a small difference in mechanical properties between the machine direction and the transverse direction and is moderately hard to elongate. For example, it has been reported that a leather-like sheet which has a soft hand and does not excessively elongate even under a large deforming stress to show an elongation limit is obtained by regulating the apparent density of substrate, the nonwoven fabric/elastic polymer mass ratio of the substrate, the thickness of grain layer, the load at 20% elongation ($\sigma 20$)/load at 5% elongation ($\sigma 5$) ratio in MD and TD of a leather-like sheet, etc. within a specified range (for example, Patent Document 1). However, since the proposed leather-like sheet is made of an entangled nonwoven fabric of short fibers, the entanglement between fibers gradually becomes loose upon elongation and the recovery is reduced. Therefore, shoes made of the proposed leather-like sheet by sewing become gradually wider during its wearing.

It has been attempted to reproduce the small stretchability and hand similar to those of natural leathers by forming the nonwoven fabric of the substrate layer from two layers with different finenesses (a layer of thicker microfine fibers and a layer of finer microfine fibers) so as to make a fineness gradient along the thickness direction, thereby imitating the natural leather structure (for example, Patent Document 2). However, since the proposed leather-like sheet is also made of an entangled nonwoven fabric of short fibers, the entanglement between fibers gradually becomes loose upon elongation and the recovery is reduced.

It has been attempted to produce a grain-finished artificial leather which combines a smoothness, a peeling strength and a hand with fullness by using a substrate composed of a nonwoven fabric made of bundles of microfine long fibers and an elastic polymer inside the nonwoven fabric (for example, Patent Document 3). However, the production method proposed merely intends to highly compact the bundles of microfine long fibers. Therefore, a leather-like sheet intended in the present invention has not been obtained, in which the ratio of mechanical properties between the machine direction and the transverse direction is nearly one.

In another proposed technique, a nonwoven fabric composed of 5 to 100 laminated fiber webs of accumulated continuous filaments each having a mass per unit area of 5 to 50 $g/m^2$ is used so as to improve the compactness and flexibility of a long-fiber nonwoven fabric and reduce the unevenness of the mass per unit area of final products (for example, Patent Documents 4 and 5). However, the production method proposed addresses only the number of fiber webs to be laminated. Therefore, a leather-like sheet intended in the present invention has not been obtained, in which the ratio of mechanical properties between the machine direction and the transverse direction is nearly one.

Patent Document 1: JP 2003-13369A
Patent Document 2: JP 11-140779A
Patent Document 3: WO 2007/069628
Patent Document 4: JP 2003-336157A
Patent Document 5: JP 2004-11075A

DISCLOSURE OF INVENTION

An object of the present invention is to provide a leather-like sheet having a natural dense feeling similar to that of natural leathers and a soft hand, and further having a small difference in mechanical properties between the machine direction and the transverse direction, a moderate difficulty in elongation and a long-lasting recovery.

As a result of extensive research in view of solving the above problems, the inventors have found a leather-like sheet achieving the above object. The present invention is based on this finding.

Namely, the present invention relates to a leather-like sheet which comprises a microfine long-fiber nonwoven fabric comprising an entangled web structure made of bundles of microfine long fibers and an elastic polymer impregnated in the microfine long-fiber nonwoven fabric, wherein (1) each of the bundles of microfine long fibers comprises 5 to 70 microfine long fibers having an average single fiber fineness of 0.5 dtex or less;

(2) the bundles of microfine long fibers have an average fineness of 3 dtex or less;

(3) the entangle web structure comprises superposed webs each comprising the bundles of microfine long fibers;

(4) a ratio of the microfine long fibers and the elastic polymer is 70/30 to 40/60 by mass;

(5) the elastic polymer is substantially continuous; and (6) a machine direction/transverse direction ratio of breaking strength is 1/1 to 1.3/1, an elongation at break in each of the machine direction and the transverse direction is 80% or more, and a machine direction/transverse direction ratio of elongation at break is 1/1 to 1/1.5.

The present invention further relates to a grain-finished leather-like sheet which is produced by forming a grain layer on one or both surfaces of the above leather-like sheet.

The present invention further relates to a method of producing a leather-like sheet which comprises the following steps (1), (2), (3), (4), (5), and (6) in this order or the following steps (1), (2), (3), (5), (4), and (6) in this order:

(1) producing a long-fiber web from composite fibers which are capable of converting into bundles containing microfine long fibers having an average single fiber fineness of 0.5 dtex or less;

(2) producing a superposed web by folding the long-fiber web at predetermined intervals continuously and repeatedly at a folding back angle of 75° or more to a machine direction of the long-fiber web;

(3) producing an entangled nonwoven fabric by entangling the superposed web;

(4) impregnating a solution of an elastic polymer to the entangled nonwoven fabric and wet-coagulating the elastic polymer;

(5) converting the composite fibers in the entangled nonwoven fabric containing the elastic polymer to bundles of microfine long fibers; and (6) heat-treating the microfine long-fiber nonwoven fabric comprising the bundles of microfine long fibers while maintaining the microfine long-fiber nonwoven fabric at least in a transverse direction at a predetermined width.

The leather-like sheet and grain-finished leather-like sheet of the invention are soft, comfortable in wearing, hard to elongate even under a heavy load and deforming stress during their wearing, and hard to deform because of their high recovery. Therefore the leather-like sheet of the invention is extremely suitable as a material for sport shoes, etc.

BEST MODE FOR CARRYING OUT THE INVENTION

Figure 1:
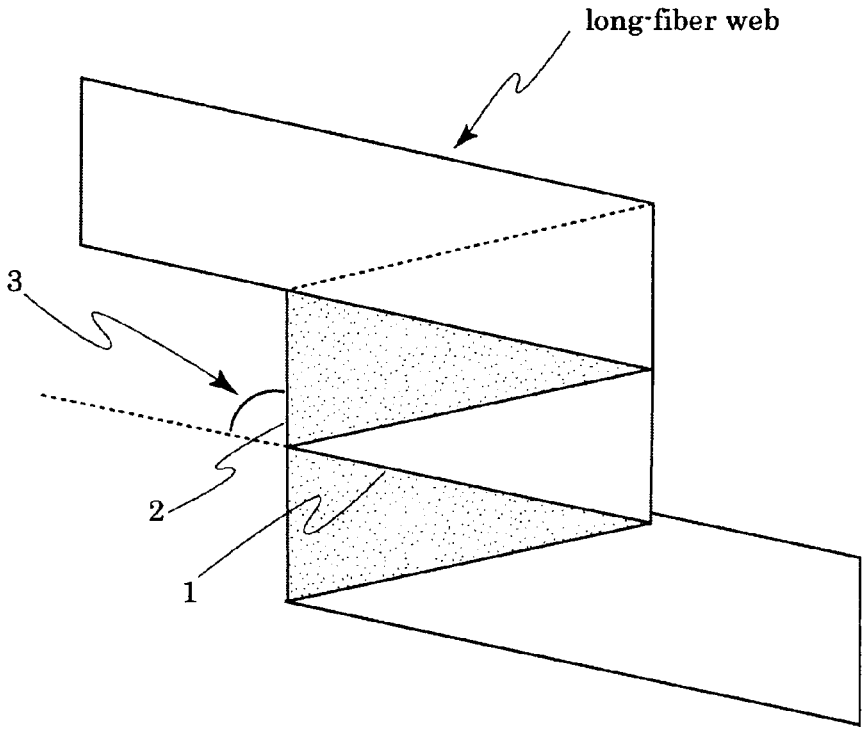
FIG. 1 is a schematic view illustrating the folding back angle to the machine direction of web.

The present invention is described below in detail. The microfine fibers for forming the leather-like sheet of the invention are not particularly limited as long as they are long fibers. In the present invention, the term "long fiber" means that as-spun continuous fibers are used without cutting. More specifically, the "long fiber" means a fiber longer than a short fiber generally having a length of about 3 to 80 mm and a fiber not intentionally cut as so done in the production of short fibers. For example, the length of the long fibers before converted to microfine fibers is preferably 100 mm or longer, and may be several meters, hundreds of meter, or several kilometers as long as being technically possible to produce or being not physically broken. Part of long fibers may be cut into short fibers in the process described below, for example, the needle punching for entanglement and the buffing of the surface of leather-like sheet, as long as the effect of the invention is not adversely affected.

In view of obtaining a good handling ability and a softness and hand resembling natural leathers, the average single fiber fineness of the microfine long fibers forming the leather-like sheet is 0.5 dtex or less, preferably 0.0001 to 0.5 dtex, and more preferably 0.001 to 0.2 dtex. The microfine long-fiber nonwoven fabric is made from the bundles of microfine long fibers having an average fineness of 3 dtex or less, each bundle containing 5 to 70 microfine long fibers having an average single fiber fineness of 0.5 dtex or less. If the average single fiber fineness of the microfine long fibers exceeds 0.5 dtex, the hand unfavorably becomes hard. If the fineness of the bundle of microfine long fibers exceeds 3 dtex, the leather-like sheet unfavorably becomes easy to elongate. If the number of the microfine long fibers in a bundle of microfine long fibers is less than 5, the leather-like sheet may become easy to elongate. If exceeding 70, the leather-like sheet may become extremely difficult to elongate.

The bundles of microfine long fibers are obtained by a known method, for example, by removing the sea component from microfine long fiber-forming fibers, i.e., sea-island fibers (composite fibers) by dissolution or decomposition. The microfine long fiber-forming fibers are produced, for example, by a mix spinning method in which a molten mixture of 2 or more kinds of polymers which are incompatible with each other is extruded from a spinneret or a composite spinning method in which the incompatible polymers are separately melted, the streams of molten polymers are joined and then extruded from a spinneret. The number of islands in the sea-island fiber is preferably 10 to 100, and the mass ratio of the sea component and the island component is preferably 10:90 to 70:30. The long-fiber web may be produced efficiently by various methods, with a spun-bonding method being preferably employed. In the spun-bonding method, molten polymers extruded from a spinneret are made thinner by drafting at a speed of 2000 to 5000 m/min using a sucking apparatus such as an air jet nozzle and then collected on a moving surface while opening the fibers to obtain a long-fiber web or a stacked long-fiber web.

The microfine long fibers correspond to the island component of the sea-island fibers mentioned above. Examples of the material for the island component include acrylic polymer, polyester, polyamide, and polyolefin, with polyamide such as nylon 6, nylon 66, nylon 610, and nylon 612 and polyester such as polyethylene terephthalate, polypropylene terephthalate, polybutylene terephthalate, and polyethylene naphthalate being preferred, and nylon 6 being more preferred. Examples of the material for the sea component of sea-island fibers include polyethylene, polystyrene, co-polyester, and thermoplastic polyvinyl alcohol.

The long-fiber web obtained by the spun-bonding method is made into a superposed web of two or more layers having a desired mass per unit area and width by continuously and repeatedly folding back the web at a folding back angle of 75° or more to the machine direction of the web at fixed intervals (distance between folding creases). The superposed web is then three-dimensionally entangled by needle punching or jet water to obtain an entangled nonwoven fabric. The fixed interval is determined according to the width of the superposed web to be produced. As shown in FIG. 1, the folding back angle 3 to the machine direction of web is the acute angle formed by the edge 1 of the web to be folded and the crease 2. The folding back angle is 75° or more, preferably 78 to 88°, and more preferably 80 to 87°. The superposed web obtained by continuously folding back the long-fiber web at the above folding back angle is made into the leather-like sheet through the steps such as an entangling treatment and an impregnating treatment of elastic polymer which will be described below. The leather-like sheet of the invention has a composite structure composed of the nonwoven fabric which is obtained by entangling the folded long-fiber web so as to have a suitable and controlled web orientation angle and the elastic polymer which is substantially continuous and fills the voids in the entangled structure. The web orientation angle is the folding back angle of the long-fiber web in the leather-like sheet. With such a composite structure, the leather-like sheet of the invention has quite unique properties not ever obtained, i.e., the ratio of the breaking strength and the ratio of the elongation at break each between the machine direction and the transverse direction are nearly one. The unique properties will be described below. If the folding back angle is less than 75°, a machine direction/transverse direction ratio of mechanical properties nearly one cannot be obtained even if the change of shape due to the process tension in subsequent steps is prevented by any manners.

The mass per unit area of the entangled nonwoven fabric is preferably 300 to 2000 g/m$^2$, although not limited thereto. A long-fiber web having an intended mass per unit area may be directly produced on a collecting net. To minimize the unevenness of the mass per unit area, however, it is preferred to produce a long-fiber web having a mass per unit area of about 20 to 50 g/m$^2$ on a collecting net and superpose the long-fiber web by cross-lapping so as to have the intended mass per unit area. The needle punching is conducted simultaneously or alternatively from both surfaces of web while allowing one or more barbs to penetrate through the web. The punching density is preferably 300 to 5000 punch/cm$^2$, and more preferably 500 to 3500 punch/cm$^2$. The obtained entangled nonwoven fabric may be pressed by a heated roll, if necessary, to make the surface flat and smooth and adjust the density.

Subsequently after the entangling treatment, the entangled nonwoven fabric is preferably impregnated with an elastic polymer. The impregnation of the elastic polymer into the entangled nonwoven fabric is preferably conducted by wet-coagulating the impregnated solution or dispersion of the elastic polymer in an organic solvent. With such impregnation, the elastic polymer forms a substantially continuous, porous structure without forming island or dotted structure, thereby enhancing the recovery from elongation. The impregnation of the elastic polymer may be conducted after the step of conversion to microfine fibers which is describe below or, if necessary, conducted twice before and after the step of conversion to microfine fibers.

The examples of the elastic polymer include, but not limited to, polyurethane, acrylonitrile-butadiene copolymer, styrene-butadiene copolymer, copolymer of acrylic ester or methacrylic ester, and silicone rubber, with polyurethane being most preferred because a good hand is obtained. The soft segment of polyurethane is at least one kind of unit selected from polyester units, polyether units, and polycarbonate units according to the final use of the leather-like sheet. Two or more kinds of elastic polymers may be used. If necessary, pigment, dye, coagulation modifier and stabilizer may be combinedly used.

Examples of the organic solvent for the elastic polymer solution include acetone, methyl ethyl ketone, tetrahydrofuran and N,N-dimethylformamide, with N,N-dimethylformamide (DMF) being particularly preferred because it is a good solvent for polyurethane and has a good wet-coagulation ability. The elastic polymer solution impregnated into the entangled nonwoven fabric is wet-coagulated preferably in a water bath at 25 to 70° C. or in a mixed bath of a good solvent for elastic polymer and water. With such a wet-coagulation, the elastic polymer coagulates in substantially continuous and porous state.

The mass ratio of the microfine long fibers and the elastic polymer both constituting the leather-like sheet is preferably 40/60 to 70/30 and more preferably 50/50 to 60/40 in view of a good recovery from elongation and a good hand. If the ratio of the microfine long fibers is too low, the hand may be rubbery. If the ratio of the microfine long fibers is too high, a sufficient recovery from elongation would not be obtained.

Next, the microfine-fiberization takes place to obtain a microfine long-fiber nonwoven fabric. When the microfine long fiber-forming fibers are sea-island fibers, the microfine-fiberization is conducted by converting the sea-island fibers to the bundles of microfine long fibers preferably at 70 to 150° C. using a liquid which is a non-solvent for the microfine fiber component (island component) and the elastic polymer but a solvent or decomposer for the sea component. When the elastic polymer is polyurethane, the island component is nylon or polyethylene terephthalate, and the sea component is polyethylene, toluene, trichloroethylene or tetrachloroethylene is used as the solvent. When the microfine fiber component (island component) is nylon or polyethylene terephthalate and the sea component is a easy alkali-decomposable modified polyester, an aqueous caustic soda is used as the composer. With the above treatments, the sea component is removed from the sea-island fibers and the sea-island fibers are converted to the bundles of microfine long fibers, thereby obtaining the microfine long-fiber nonwoven fabric impregnated with elastic polymer (hereinafter simply referred to as "microfine long-fiber nonwoven fabric").

In the initial stage of the three-dimensional entangling treatment mentioned above, the webs superposed are not sufficiently entangled and in a mere transversely and continuously folded state. Therefore, the web easily changes its shape by the process tension in the production steps. In the known production methods, before reaching the desired degree of entanglement, the web is elongated by the process tension in the machine direction by 50% or more and about 100% in some cases as a result, the web is shrunk in the transverse direction by 20% or more. Since the change of the web shape in the entangling step cannot be prevented in the known production methods, the web orientation angle is no longer kept at 73° or more even at the entangling treatment. Since the microfine-fiberization generates easy-to-move microfine fibers and bundles of microfine fibers, the microfine-fiberization mentioned above is essential for extremely enhancing the commercial value of the leather-like sheet such as hand. On the other hand, the structure of the entangled nonwoven fabric abruptly becomes loose. Therefore, in the known production methods of leather-like sheet, the entangled nonwoven fabric is elongated by the process tension in the machine direction by about 10% or more, as a result, the fabric is shrunk in the transverse direction by about 15% or more during the microfine-fiberization step. Thus, in the known production methods, it is very difficult to maintain the web orientation angle at 73° or more by minimizing the influence of the process tension during the entangling treatment and the microfine-fiberization which are very important steps for obtaining the entangled nonwoven fabric structure of the leather-like sheet.

In the production method of the invention, however, since the change of web shape due to the process tension in the entangling treatment and the microfine-fiberization is prevented largely, a leather-like sheet having a web orientation angle of 73° or more is obtained, i.e., a fiber-entangled structure in which fibers are oriented similarly in the machine direction and the transverse direction is obtained. Therefore, a leather-like sheet which combines a natural dense feeling and soft hand resembling natural leathers, a small difference between the mechanical properties in the machine direction and the transverse direction, a moderate resistance to elongation, and a durable recovery is obtained. The web orientation angle of the leather-like sheet is 73° or more and preferably 75° or more. The upper limit of the web orientation angle is preferably 86° or less. Within the above range, the ratio of the breaking strength and the ratio of the elongation at break between the machine direction and the transverse direction come nearly one.

The obtained microfine long-fiber nonwoven fabric may be provided, if necessary, with an oil agent to reduce the friction coefficient between fibers. Generally, a lubricant for reducing the friction coefficient is used as the oil agent. A silicone-type oil agent is preferably used. The oil agent is provided by a method in which the oil agent is forced into the microfine long-fiber nonwoven fabric by dip-nip using an aqueous solution or dispersion of the oil agent, a method of spraying the oil agent and allowing the oil agent to penetrate into the microfine long-fiber nonwoven fabric, a method of applying the oil agent by a bar coater, a knife coater or a comma coater to allow the oil agent to penetrate into the microfine long-fiber nonwoven fabric, or a combination of the above methods. The amount the oil agent (solid basis) to be provided is 0.1 to 10 mass % and preferably 1 to 5 mass % based on the finally obtained leather-like sheet. Within the above ranges, a moderate sliding action between fibers are obtained in the composite structure composed of the microfine long-fiber nonwoven fabric which is constituted from the entangled structure of bundles of microfine long fibers and the elastic polymer impregnated therein. With such a moderate sliding action, a moderate elongation and a quick recovery from the elongation are obtained.

Then, the microfine long-fiber nonwoven fabric is heat-treated by a known method using a steam dryer or an infrared dryer. During the heat treatment, at least the width of the microfine long-fiber nonwoven fabric in the transverse direction (TD) is maintained at a fixed length. If the microfine long-fiber nonwoven fabric is spontaneously elongated by heating in the transverse direction, the width is maintained taking such a spontaneous elongation into consideration. Despite such a spontaneous elongation, the heat treatment is preferably conducted by gradually increasing the width to be maintained. In addition to maintaining the width as described above, the microfine long-fiber nonwoven fabric is heat-treated at an ambient temperature of 80 to 130° C. for 5 to 20 min. If the microfine long-fiber nonwoven fabric is wet, the heat treatment may serve as the drying treatment. In the heat treatment while increasing the width to be maintained, it is preferred to make the line speed of the heat treatment slower than the line speed just before the heat treatment, i.e., over feed the microfine long-fiber nonwoven fabric, because the width is spontaneously increased in the transverse direction without preventing the spontaneous shrinkage of the microfine long-fiber nonwoven fabric in the machine direction (MD). The over feed (shrinkage) in the machine direction is preferably 0.5 to 5% and the width increase in the transverse direction is preferably 1 to 10% in view of avoiding the unevenness of the properties and shape of the leather-like sheet in the machine direction and the transverse direction, although not particularly limited thereto.

Figure 2:
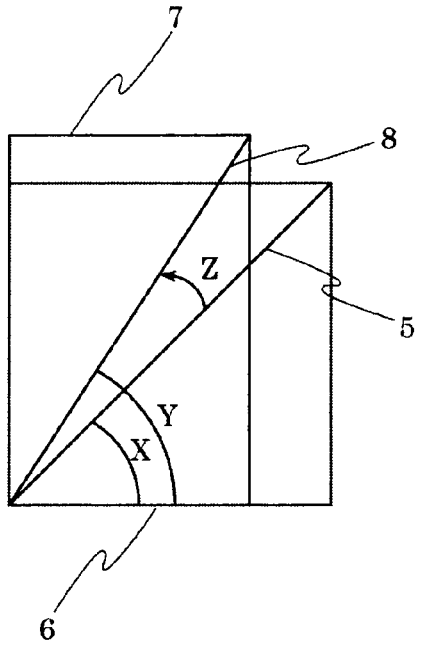
FIG. 2 is a schematic view illustrating a morphologic angle and the difference between the morphologic angle just before the step (3) and the morphologic angle immediately after the step (6).

To obtain a leather-like sheet intended in the present invent which has quite unique properties not ever achieved, the heat treatment is conducted so that the absolute value of the difference between the morphologic angle just after the heat treatment and the morphologic angle just before the entangling treatment is preferably 18° or less, more preferably 15° or less and still more preferably 0 to 13°. The morphologic angle just before the entangling treatment is, as shown in FIG. 2, the angle X (45° between the diagonal 5 of the square 4 drawn on the surface of the superposed web just before the entangling treatment and the side 6 along the transverse direction. The square 4 is deformed generally to a rectangle during the subsequent steps. For example, the square 4 is deformed to the rectangle 7 by the tension in the machine direction. The angle Y between the diagonal 8 of the rectangle 7 and the side 6 along the transverse direction is the morphologic angle just after the heat treatment. The morphologic angle just after the heat treatment exceeds 45°. If the tension is applied in the transverse direction, the morphologic angle becomes less than 45°.

In the known method of producing a leather-like sheet from an entangled nonwoven fabric of composite fibers convertible to bundles of microfine fibers without using a reinforcing sheet such as a woven or knit fabric, the elongation in the machine direction due to the process tension, particularly the process tension during the microfine-fiberization cannot be avoided and therefore the absolute value of the difference of the morphologic angle must be 20 to 30° and exceeds 30° when the mass per unit area is small. In the present invention, however, the absolute value of the difference of the morphologic angle (angle Z in FIG. 2) is regulated within 18° or less, because the long-fiber web is entangled after folding back at a specific folding back angle and the resulting entangled nonwoven fabric is made into a composite structure impregnated with the elastic polymer in the specific existing state, as mentioned above. In addition, the web orientation angle in the leather-like sheet can be kept at 73° or more. The leather-like sheet meeting the above requirements combines a small difference in the mechanical properties between the machine direction and the transverse direction, a moderate resistance to elongation, and a durable recovery from elongation.

Since the present invention employs the production method not ever known, the mechanical properties (for example, breaking strength, elongation at break, and recovery) of the leather-like sheet in the machine direction and the transverse direction are nearly the same or the difference thereof is very small. The machine direction/transverse direction ratio of the breaking strength is 1/1 to 1.3/1, the elongation at break in each of the machine direction and the transverse direction is 80% or more and preferably 80 to 150%, and the machine direction/transverse direction ratio thereof is 1/1 to 1/1.5.

The recovery of the leather-like sheet was measured by the following method using the elongation A under a load of 8 kg/2.5 cm and the elongation B after removing the load, which are measured on a leather-like sheet having a breaking strength of 50 kg/2.5 cm or more, preferably 50 to 80 kg/2.5 cm in each of the machine direction and the transverse direction. A sample having a arbitrary thickness, a length of 25 cm in the machine direction (MD) and a width of 2.54 cm in the transverse direction (TD), on which gage marks at interval of 20 cm in the machine direction had been drawn, was held vertically with the machine direction along the vertical direction. Then, a load of 8 kg/2.5 cm was put at the lower end of the sample. After 10 min, the distance between the gage marks (length under load) was measured and immediately thereafter the load was removed. After 10 min from removing the load, the distance between the gage marks (length after unloading) was measured. The elongation A1 under loading was calculated from the following expression:

$$(\text{length under load}-\text{initial length})/(\text{initial length})\times 100,$$

and the elongation B1 after unloading was calculated from the expression:

$$(\text{length after unloading}-\text{initial length})/(\text{initial length})\times 100.$$

The elongation A1 under loading is preferably 40% or less (A1≤40%), more preferably 16 to 40%, and still more preferably 18 to 35%. The elongation B1 after unloading is preferably 15% or less (B1≤15%), more preferably 5 to 15%, and still more preferably 7 to 10%. The difference between the elongation A1 and the elongation B1 is preferably 10 to 30% (10%≤A1−B1≤30%) and more preferably 15 to 25%. With the elongations meeting the above requirements, the leather-like sheet of the invention exhibits a good initial recovery.

After repeating 9 times the 10-minute elongation operation under a load of 8 kg/2.5 cm and the 10-minute operation of keeping unloaded, the elongation A10 under loading was determined in the same manner as in the elongation A1. After repeating 10 times the elongation/keeping unloaded operation, the elongation B10 after unloading was determined in the same manner as in the elongation B1. The elongation A10 under loading is preferably 40% or less (A10≤40%), more preferably 17 to 40%, and still more preferably 20 to 36%. The elongation B10 after unloading is preferably 15% or less (B10≤15%), more preferably 10 to 15%, and still more preferably 10 to 13%. The difference between the elongation A10 and the elongation B10 is preferably 10 to 30% (10%≤A10−B10≤30%) and more preferably 15 to 25%. With the elongations meeting the above requirements, the leather-like sheet of the invention exhibits a good recovery even after repeated elongations.

In the leather-like sheet of the invention, the difference between the elongation A10 and the elongation A1 is preferably 9% or less (A10−A1≤9%), more preferably 1 to 6%, and still more preferably 2 to 5%. The difference between the elongation B10 and the elongation B1 is preferably 4% or less (B10−B1≤4%), more preferably 0 to 3%, and still more preferably 1 to 3%. With the elongations meeting the above requirements, the leather-like sheet of the invention exhibits a moderate resistance to elongation even after repeated elongations.

The apparent density of the leather-like sheet produced as described above is preferably 0.2 to 0.98 g/cm$^3$, the thickness is preferably 0.25 to 2.9 mm, and the mass per unit area is preferably 250 to 1000 g/m$^2$. The bundles of microfine long fibers are preferably covered with the substantially continuous, porous elastic polymer.

The leather-like sheet is made into a grain-finished leather-like sheet by forming a grain layer on one or both surfaces thereof. The grain layer is formed by a laminate method in which a resin film mainly composed of an elastic polymer which is formed on a release paper is adhered to the surface of the leather-like sheet via an adhesive (for example, polyurethane adhesive) and then the release paper is peeled off; a method in which a film is formed by applying an elastic polymer solution on the surface of the leather-like sheet by a bar coater, a knife coater or a comma coater and then the film is embossed to form a desired pattern; or a method in which a porous film is formed on the surface of the leather-like sheet so as to obtain a softer hand. The porous film is formed, for example, by a method in which an elastic polymer solution is coated on the surface of the leather-like sheet and then the coated leather-like sheet is immersed in a coagulation bath of an aqueous solution of dimethylformamide (DMF) or only water to coagulate the elastic polymer; a method of applying an elastic polymer solution added with a thermally expandable particles on the surface of the leather-like sheet; or a method of applying a mechanically stirred elastic polymer solution on the leather-like sheet. The degree of foaming and foamed state are controlled, for example, by suitably selecting the concentration of the elastic polymer solution, the wet coagulation condition such as DMF concentration of the coagulation liquid and temperature of the coagulation liquid, the addition amount of the thermally expandable particles and the stirring condition of the elastic polymer solution.

The thickness of the grain layer is preferably 10 to 200 μm when not porous. Within the above range, a grain-finished leather-like sheet with a good surface strength and a soft hand is obtained. The thickness is preferably 50 to 300 μm when porous. Within the above range, a grain-finished leather-like sheet with a soft touch is obtained. In addition, a thick and rubbery feel is prevented from being strengthened, thereby obtaining a grain-finished leather-like sheet with a natural leather-like hand.

The elastic polymer solution for forming the grain layer may be added with a known additive such as thickening agent, hardener, bulking agent, filler, light stabilizer, antioxidant, ultraviolet absorber, fluorescent agent, antifungal agent, flame retardant, penetrant, surfactant, water-soluble polymer such as polyvinyl alcohol and carboxymethylcellulose, dye, pigment, and adhesive.

Polyurethane is most preferably used as the elastic polymer for the grain layer and adhesive. A known polyurethane is usable and other resins may be combinedly used. In view of recent demand for durability in various applications, a polyurethane with a good durability such as polyether-type polyurethane and polycarbonate-type polyurethane is preferably used. The modulus at 100% elongation, a measure for the hardness of polyurethane, is preferably 10 to 150 kg/cm$^2$. Within the above range, polyurethane has a sufficient mechanical strength and a good flexibility, and therefore, a grain-finished leather-like sheet with a soft hand and free from artificial and coarse wrinkles is obtained.

It is preferred to conduct, if necessary, a crumpling treatment before or after forming the grain layer so as to enhance the flexibility and provide natural leather-like wrinkles. The crumpling treatment is conducted by using a known machine such as high-pressure jet dyeing machine, wince, tumbler, and mechanical crumpling machine. These means may be combinedly used. By any means, the flexibility is further improved and natural leather-like wrinkles are formed. By additional mechanical crumpling treatment after forming the grain layer, a grain-finished leather-like sheet with a good flexibility and natural leather-like wrinkles is obtained.

The grain-finished leather-like sheet obtained as described above has mechanical properties (breaking strength, elongation at break, and elongations A1, A10, B1, and B10) nearly the same as those of the leather-like sheet constituting the grain-finished leather-like sheet.

EXAMPLES

The present invention will be described in more detail with reference to the examples. However, it should be noted that the scope of the present invention is not limited thereto. The terms "part(s)" and "%" used in the following examples are based on mass unless otherwise noted.

The properties were measured by the following methods.

(1) Average Single Fiber Fineness of Microfine Long Fibers, Number of Microfine Long Fibers in Bundle of Microfine Long Fibers, and Fineness of Bundles of Microfine Long Fibers A cross section of a leather-like sheet taken along the thickness direction was observed under a scanning electron microscope (magnification: about 100 to 300). Twenty bundles of microfine long fibers which oriented vertically with respect to the cross section were randomly selected from all around the field. The cross section of each of the selected bundles of microfine long fibers was magnified by about 1000 to 3000 times and the average cross-sectional area of the microfine long fibers was obtained. The average single fiber fineness of the microfine long fibers was calculated from the average cross-sectional area and the specific gravity of the polymer constituting the microfine long fibers. The number of the microfine long fibers in the bundle of microfine long fiber is obtained in the same manner.

(2) Fineness of Bundles of Microfine Long Fibers

The cross-sectional area of each of 20 bundles of microfine long fibers was calculated from the cross-sectional area of the microfine long fiber and the number of microfine long fibers each obtained above. The maximum and minimum cross-sectional areas were cut and the remaining 18 cross-sectional areas were arithmetically averaged. The average fineness of the bundles of microfine long fibers was calculated from the obtained average cross-sectional area and the specific gravity of the polymer constituting the microfine long fibers.

(3) Thickness and Mass Per Unit Area

Measured according to JIS L1096:1999 8.5 and JIS L1096:1999 8.10.1, respectively.

(4) Breaking Strength and Elongation at Break

Measured according to JIS L1096, 6.12 "Test for Tensile Strength." The stress at break was read from the stress-strain curve and the elongation at break was determined from the elongation when broken.

(5) Elongations A1, A10, B1 and B10

Described above.

Example 1

Nylon6 and polyethylene were separately melted in a single screw extruder and extruded from a composite spinning nozzle to melt-spin sea-island composite fibers with a mass ratio of 50:50 and 25 islands. The sea-island composite fibers extruded from the composite spinning nozzle were blown on to a collecting net while drawing by air jet of a speed of 3500 m/min to obtain a long-fiber web. The mass per unit area of the obtained long-fiber web was 36 g/m$^2$ and the single fiber fineness of the sea-island composite fibers was 2 dtex. The long-fiber web was continuously and repeatedly folded at fixed intervals at a folding back angle of 84° to the machine direction of web, thereby obtaining a superposed web with ten layers of webs which had a width of 210 cm and a mass per unit area or 360 g/m$^2$. The superposed web was needle-punched by felt needles with one barb at a punching density of 1400 punch/cm$^2$ and then hot-pressed between heated rolls, thereby obtaining an entangled nonwoven fabric of the sea-island composite fibers which had a mass per unit area of 416 g/m$^2$ and a thickness of 1.43 mm. A 18% solution of a polyester-type polyurethane in dimethylformamide (DMF) was impregnated into the entangled nonwoven fabric and wet-coagulated in porous state in water. Thereafter, the sea-island composite fibers were converted to bundles of microfine long fibers by removing the sea component (polyethylene) with toluene at 95° C., thereby obtaining a microfine long-fiber nonwoven fabric. An aqueous dispersion of a silicone-type oil agent known as a lubricant for improving the sliding between nylon 6 microfine fibers was provided to the microfine long-fiber nonwoven fabric in an amount of 1.8% based on the leather-like sheet to be obtained. The morphologic angle immediately after providing the oil agent was 56°, by letting the morphologic angle of the superposed web just before the entangling treatment 45°. Then, the microfine long-fiber nonwoven fabric was heat-treated and dried at the same time at an ambient temperature of 120° C. while over feeding in the machine direction (MD) by 2% and increasing the width in the transverse direction (TD) by 3%, thereby obtaining a leather-like sheet. The morphologic angle after the heat treatment was 55° and the absolute value of the difference between the morphologic angle just before the entangling treatment and after the heat treatment was 10°. The properties of the obtained leather-like sheet are shown in Table 1.

A grain layer was formed on one surface of the leather-like sheet by a laminate method under the following conditions.

Release pager: DE-123

Composition of coating solution

Surface layer

- 100 parts: NY-214 (silicone-modified polyether-type polyurethane manufactured by Dainippon Ink & Chemicals, Inc.)
- 30 parts: DUT-4790 (black pigment manufactured by Dainichiseika Color & Chemicals Mfg. Co., Ltd.)
- 35 parts: DMF
- application amount (wet basis): 120 g/m$^2$ Adhesive layer

- 100 parts: UD-8310 (polyether-type polyurethane manufactured by Dainichiseika Color & Chemicals Mfg. Co., Ltd.)
- 10 parts: D-110N (cross-linking agent manufactured by Takeda Pharmaceutical Company Limited)
- 1.5 parts: QS (cross-linking promoter manufactured by Takeda Pharmaceutical Company Limited)
- 10 parts: DMF
- 20 parts: ethyl acetate
- application amount (wet basis): 150 g/m$^2$ Immediately after forming the grain layer, the sheet was cured in a dryer having an ambient temperature of 60° C. for 48 h, thereby promoting the cross-linking reaction between the polyurethane, cross-linking agent and cross-linking promoter in the adhesive layer. After peeling off the release paper, the sheet was mechanically crumpled to obtain a black grain-finished leather-like sheet having a grain layer of 50 μm thick. The properties of the obtained grain-finished leather-like sheet are shown in Table 1.

The obtained grain-finished leather-like sheet was soft and resistant to elongation and had a good recovery and a natural leather-like hand, and therefore, particularly suitable for the production of sport shoes, etc. Soccer shoes produced by using the grain-finished leather-like sheet were soft, free from loss of shapes and excellently comfortable.

Example 2

Nylon 6 and polyethylene were separately melted in a single screw extruder and extruded from a composite spinning nozzle to melt-spin sea-island composite fibers with a mass ratio of 50:50 and 25 islands. The sea-island composite fibers extruded from the composite spinning nozzle were blown on to a collecting net while drawing by air jet of a speed of 3500 m/min to obtain a long-fiber web. The mass per unit area of the obtained long-fiber web was 36 g/m$^2$ and the single fiber fineness of the sea-island composite fibers was 2 dtex. The long-fiber web was continuously and repeatedly folded at fixed intervals at a folding back angle of 82° to the machine direction of web, thereby obtaining a superposed web with eight layers of webs which had a width of 210 cm and a mass per unit area or 288 g/m$^2$. The superposed web was needle-punched by felt needles with one barb at a punching density of 1500 punch/cm$^2$ and then hot-pressed between heated rolls, thereby obtaining an entangled nonwoven fabric of the sea-island composite fibers which had a mass per unit area of 332 g/m$^2$ and a thickness of 1.14 mm. A 20% solution of a polyester-type polyurethane in dimethylformamide (DMF) was impregnated into the entangled nonwoven fabric and wet-coagulated in porous state in water. Thereafter, the sea-island composite fibers were converted to bundles of microfine long fibers by removing the sea component (polyethylene) with toluene at 95° C., thereby obtaining a microfine long-fiber nonwoven fabric. An aqueous dispersion of a silicone-type oil agent known as a lubricant for improving the sliding between nylon 6 microfine fibers was provided to the microfine long-fiber nonwoven fabric in an amount of 1.5% based on the leather-like sheet to be obtained. The morphologic angle immediately after providing the oil agent was 59°, by letting the morphologic angle of the superposed web just before the entangling treatment 45°. Then, the microfine long-fiber nonwoven fabric was heat-treated and dried at the same time at an ambient temperature of 120° C. while over feeding in the machine direction by 1% and increasing the width in the transverse direction by 9%, thereby obtaining a leather-like sheet. The morphologic angle after the heat treatment was 57° and the absolute value of the difference between the morphologic angle just before the entangling treatment and after the heat treatment was 12°. The properties of the obtained leather-like sheet are shown in Table 1.

A grain layer was formed on one surface of the obtained leather-like sheet and the resulting sheet was cured each in the same manner as in Example 1. After peeling off the release paper, the sheet was mechanically crumpled to obtain a black grain-finished leather-like sheet having a grain layer of 50 μm thick. The properties of the obtained grain-finished leather-like sheet are shown in Table 1.

The obtained grain-finished leather-like sheet was soft and resistant to elongation and had a good recovery and a natural leather-like hand, and therefore, particularly suitable for the production of sport shoes, etc. Basket shoes produced by using the grain-finished leather-like sheet were soft, free from loss of shapes and excellently comfortable.

Comparative Example 1

A leather-like sheet was produced in the same manner as in Example 1 except for using a 20% aqueous dispersion of a polyester-type polyurethane and dry-coagulating it in place of using a 18% solution of a polyester-type polyurethane in dimethylformamide and wet-coagulating it in water. The morphologic angle of the obtained leather-like sheet was 51° and the absolute value of the difference between it and the morphologic angle of the superposed web was 6°. The formation of grain layer on one surface of the obtained leather-like sheet, the curing treatment and the mechanical crumpling treatment after peeling off the release paper were conducted in the same manner as in Example 1, thereby obtaining a black grain-finished leather-like sheet having a grain layer of 50 μm thick. The properties of the obtained leather-like sheet and grain-finished leather-like sheet are shown in Table 1.

The obtained grain-finished leather-like sheet was soft, but less stiff and nonwoven fabric-like. Since the elastic polymer failed to fill the voids of the entangled structure in the substantially continuous state, the sheet was easy to elongate and had a poor recovery. Therefore, the obtained sheet was not a grain-finished leather-like sheet having a natural leather-like hand. Unlike the soccer shoes of Example 1, soccer shoes produced by using the grain-finished leather-like sheet in the same manner as in Example 1 lost their shape during their wearing. Therefore, the obtained sheet was not suitable for sport shoes.

Comparative Example 2

Nylon 6 and polyethylene were mixed in a mass ratio of 50:50, melted in the same melting zone and melt-spun to obtain sea-island composite fibers with about 4000 islands in average and a single fiber fineness of 10 dtex. The sea-island composite fibers were drawn by 3.0 times under moist heat condition, crimpled and then cut into short fibers of 51 mm long. The short fibers were carded and opened to obtain a short fiber-web having a mass per unit area of 25 g/m$^2$. The short fiber-web was continuously and repeatedly folded at fixed intervals at a folding back angle of 83° to the machine direction of web, thereby obtaining a superposed web with 24 layers of webs which had a width of 288 cm and a mass per unit area of 600 g/m$^2$. The superposed web was needle punched by felt needles with one barb at a punching density of 1500 punch/cm$^2$ and then hot-pressed between heated rolls, thereby obtaining an entangled nonwoven fabric of the sea-island composite fibers which had a mass per unit area of 453 g/m$^2$ and a thickness of 1.42 mm. The entangled nonwoven fabric was further treated up to providing the oil agent in the same manner as in Example 1. The morphologic angle immediately after providing the oil agent was 73°, by letting the morphologic angle of the superposed web just before the entangling treatment 45°. Then, the microtine long-fiber nonwoven fabric was heat-treated and dried at the same time at an ambient temperature of 120° C. while over feeding in the machine direction by 1% and increasing the width in the transverse direction by 10%, thereby obtaining a leather-like sheet. The morphologic angle after the heat treatment was 71° and the absolute value of the difference between the morphologic angle just before the entangling treatment and after the heat treatment was 26°. The formation of grain layer on one surface of the obtained leather-like sheet, the curing treatment and the mechanical crumpling treatment after peeling off the release paper were conducted in the same manner as in Example 1, thereby obtaining a black grain-finished leather-like sheet having a grain layer of 50 μm thick. The properties of the obtained leather-like sheet and grain-finished leather-like sheet are shown in Table 1.

The obtained grain-finished leather-like sheet had a soft but rubbery hand and was quite easy to elongate. Unlike the soccer shoes of Example 1, soccer shoes produced by using the grain-finished leather-like sheet in the same manner as in Example 1 were excessively elongated during their wearing to lose the shape, and therefore, not suitable for sport shoes.

TABLE 1

| | Examples | | Comparative Examples | |
|---|---|---|---|---|
| | 1 | 2 | 1 | 2 |
| (A) Leather-like Sheet | | | | |
| Thickness (mm) | 1.05 | 0.85 | 0.91 | 0.98 |
| Mass per unit area (g/m$^2$) | 403 | 315 | 403 | 415 |
| Microfine fibers | long fibers | long fibers | long fibers | short fibers |
| Average single fiber fineness (dtex) | 0.08 | 0.08 | 0.08 | 0.007 |
| Bundles of microfine fibers | | | | |
| fineness (dtex) | 2 | 2 | 2 | 5 |
| number of microfine fibers | 25 | 25 | 25 | 4000 |
| Microfine fibers/elastic polymer (by mass) | 45/55 | 46/54 | 50/50 | 42/58 |
| Web orientation angle (°) | 82 | 78 | 83 | 70 |
| Breaking strength (kg/2.5 cm) | | | | |
| machine direction | 54 | 50 | 48 | 47 |
| transverse direction | 50 | 49 | 37 | 30 |
| machine direction/ transverse direction | 1.08/1 | 1.02/1 | 1.29/1 | 1.57/1 |
| Elongation at break (%) | | | | |
| machine direction | 106 | 105 | 98 | 92 |
| transverse direction | 134 | 130 | 172 | 145 |
| machine direction/ transverse direction | 1/1.26 | 1/1.24 | 1/1.76 | 1/1.57 |
| Elongations A and B (%) | | | | |
| elongation A1 | 30 | 32 | 41 | 57 |
| elongation B1 | 10 | 9 | 22 | 8 |
| A1 − B1 | 20 | 23 | 19 | 49 |
| elongation A10 | 33 | 34 | 53 | 68 |
| elongation B10 | 12 | 11 | 31 | 13 |
| A10 − B10 | 21 | 23 | 22 | 55 |
| A10 − A1 | 3 | 2 | 12 | 11 |
| B10 − B1 | 2 | 2 | 9 | 5 |
| (B) Grain-Finished Leather-Like Sheet | | | | |
| Breaking strength (kg/2.5 cm) | | | | |
| machine direction | 59 | 55 | 50 | 50 |
| transverse direction | 53 | 55 | 40 | 31 |
| machine direction/ transverse direction | 1.11/1 | 1.0/1 | 1.25/1 | 1.61/1 |
| Elongation at break (%) | | | | |
| machine direction | 110 | 103 | 100 | 90 |
| transverse direction | 140 | 140 | 170 | 148 |
| machine direction/ transverse direction | 1/1.27 | 1/1.36 | 1/1.7 | 1/1.64 |

TABLE 1-continued

| | Examples | | Comparative Examples | |
|---|---|---|---|---|
| | 1 | 2 | 1 | 2 |
| Elongations A and B (%) | | | | |
| elongation A1 | 28 | 30 | 40 | 55 |
| elongation B1 | 8 | 7 | 20 | 7 |
| A1 – B1 | 20 | 23 | 20 | 48 |
| elongation A10 | 31 | 33 | 50 | 64 |
| elongation B10 | 11 | 10 | 30 | 13 |
| A10 – B10 | 20 | 23 | 20 | 51 |
| A10 – A1 | 3 | 3 | 10 | 9 |
| B10 – B1 | 3 | 3 | 10 | 6 |

INDUSTRIAL APPLICABILITY

The leather-like sheet of the invention has a natural dense feeling resembling natural leathers and a soft hand. In addition, the leather-like sheet has properties which are nearly the same in the machine direction and the transverse direction, a moderate resistance to elongation, and a recovery, and therefore, the leather-like sheet is applicable to the production of shoes and bags.

What is claimed is:

1. A leather-like sheet which comprises a microfine long-fiber nonwoven fabric comprising an entangled web structure comprising bundles of microfine long fibers and an elastic polymer impregnated in the microfine long-fiber nonwoven fabric, wherein (1) each of the bundles of microfine long fibers comprises 5 to 70 microfine long fibers having an average single fiber fineness of 0.5 dtex or less;

(2) the bundles of microfine long fibers have an average fineness of 3 dtex or less;

(3) the entangled web structure comprises superposed webs, wherein the superposed webs comprise a long-fiber web obtained from composite fibers by a spunbonding method, wherein the composite fibers are capable of converting into the bundles of microfine long fibers, and wherein each of the superposed webs comprises the bundles of microfine long fibers;

(4) a web orientation angle in the leather-like sheet is 73° or more, wherein the web orientation angle in the leather-like sheet is the web orientation angle at least after an entangled treatment and a microfine-fiberization;

(5) a ratio of the microfine long fibers and the elastic polymer is 70/30 to 40/60 by mass;

(6) the elastic polymer is substantially continuous;

(7) the leather-like sheet comprises an oil agent in an amount of 0.1 to 10 mass % on the basis of the leather-like sheet; and (8) a machine direction/transverse direction ratio of breaking strength is 1/1 to 1.3/1, an elongation at break in each of the machine direction and the transverse direction is 80% or more, and a machine direction/transverse direction ratio of elongation at break is 1/1 to 1/1.5, and wherein the leather-like sheet satisfies the following properties (i) to (viii):

$$A1 \leq 40\% \quad \text{(i)}$$

$$B1 \leq 15\% \quad \text{(ii)}$$

$$10\% \leq A1 - B1 \leq 30\% \quad \text{(iii)}$$

$$A10 \leq 40\% \quad \text{(iv)}$$

$$B10 \leq 15\% \quad \text{(v)}$$

$$10\% \leq A10 - B10 \leq 30\% \quad \text{(vi)}$$

$$A10 - A1 \leq 9\% \quad \text{(vii)}$$

$$B10 - B1 \leq 4\% \quad \text{(viii)}$$

wherein A1 is an elongation obtained by the following expression:

(length under load−initial length)/(initial length)×100 wherein the length under load is a length of the leather-like sheet when a load of 8 kg/2.5 cm is put at a lower end of the leather-like sheet held vertically;

B1 is an elongation obtained by the following expression after unloading:

(length after unloading−initial length)/(initial length)×100;

A10 is an elongation when loaded after repeating a loading/unloading operation 9 times and obtained by the same manner as in A1; and B10 is an elongation after repeating the loading/unloading operation 10 times and obtained by the same manner as in B1.

2. The leather-like sheet according to claim 1, wherein the breaking strength in each of the machine direction and the transverse direction is 50 kg/2.5 cm or more.

3. A grain-finished leather-like sheet produced by a process comprising forming a grain layer on one or both surfaces of the leather-like sheet according to claim 1.

4. The grain-finished leather-like sheet according to claim 3, wherein:

a breaking strength in each of the machine direction and the transverse direction is 50 kg/2.5 cm or more, a machine direction/transverse direction ratio of the breaking strength is 1/1 to 1.3/1, an elongation at break in each of the machine direction and the transverse direction is 80% or more, a machine direction/transverse direction ratio of the elongation at break is 1/1 to 1/1.5, and wherein the grain-finished leather-like sheet satisfies the following properties (i) to (viii):

$$A1 \leq 40\% \quad \text{(i)}$$

$$B1 \leq 15\% \quad \text{(ii)}$$

$$10\% \leq A1 - B1 \leq 30\% \quad \text{(iii)}$$

$$A10 \leq 40\% \quad \text{(iv)}$$

$$B10 \leq 15\% \quad \text{(v)}$$

$$10\% \leq A10 - B10 \leq 30\% \quad \text{(vi)}$$

$$A10 - A1 \leq 9\% \quad \text{(vii)}$$

$$B10 - B1 \leq 4\% \quad \text{(viii)}$$

wherein A1 is an elongation obtained by the following expression:

(length under load−initial length)/(initial length)×100 wherein the length under load is a length of the leather-like sheet when a load of 8 kg/2.5 cm is put at a lower end of the leather-like sheet held vertically;

B1 is an elongation obtained by the following expression after unloading:

(length after unloading−initial length)/(initial length)×100;

A10 is an elongation when loaded after repeating a loading/unloading operation 9 times and obtained by the same manner as in A1; and B10 is an elongation after repeating the loading/unloading operation 10 times and obtained by the same manner as in B1.

5. A method of producing the leather-like sheet of claim 1, the method comprising, sequentially, (1), (2), (3), (4), (5), and (6), or, sequentially, (1), (2), (3), (5), (4), and (6):

(1) producing a long-fiber web from composite fibers which are capable of converting into bundles comprising microfine long fibers having an average single fiber fineness of 0.5 dtex or less;

(2) producing a superposed web by folding the long-fiber web at predetermined intervals continuously and repeatedly at a folding back angle of 75° or more to a machine direction of the long-fiber web;

(3) producing an entangled nonwoven fabric by entangling the superposed web;

(4) impregnating a solution of an elastic polymer to the entangled nonwoven fabric and wet-coagulating the elastic polymer;

(5) converting the composite fibers in the entangled nonwoven fabric comprising the elastic polymer to bundles of microfine long fibers; and (6) heat-treating a microfine long-fiber nonwoven fabric comprising the bundles of microfine long fibers while maintaining the microfine long-fiber nonwoven fabric at least in a transverse direction at a predetermined width.

6. The method according to claim 5, wherein the folding back angle is 78 to 88° and an absolute value of a difference between a morphologic angle just before (3) and a morphologic angle immediately after (6) is 18° or less.

7. The method according to claim 5, wherein an aqueous oil agent is provided to the entangled nonwoven fabric between (5) and (6).

8. The leather-like sheet according to claim 1, wherein the long fibers have a length of 100 mm or more before being converted to microfine fibers.

9. The leather-like sheet according to claim 1, wherein the web orientation angle in the leather-like sheet is 73 to 86°.

* * * * *